US006941609B2

(12) United States Patent
Woodruff et al.

(10) Patent No.: US 6,941,609 B2
(45) Date of Patent: Sep. 13, 2005

(54) PAINT ROLLER ASSEMBLY

(76) Inventors: James Woodruff, 106 Great Hollow Rd., West Cornwall, CT (US) 06796; David R. Quigley, 426 Main St., Torrington, CT (US) 06790

( * ) Notice: Subject to any disclaimer, the term of this patent is extended or adjusted under 35 U.S.C. 154(b) by 125 days.

(21) Appl. No.: 10/417,304

(22) Filed: Apr. 16, 2003

(65) Prior Publication Data

US 2004/0205921 A1 Oct. 21, 2004

(51) Int. Cl.[7] ..... B05C 17/02

(52) U.S. Cl. ..... 15/230.11; D4/122; 492/13; 492/19

(58) Field of Search ..... 15/151, 152, 230, 15/230.11; D4/122; 492/13, 19

(56) References Cited

U.S. PATENT DOCUMENTS 2,478,318 A * 8/1949 Raub, Jr ..... 401/197
2,766,473 A * 10/1956 Thackara ..... 15/230.11
2,889,613 A * 6/1959 Madara ..... 492/19
4,467,509 A * 8/1984 Dezen ..... 492/19
5,613,265 A * 3/1997 Gemmell ..... 15/230.11
6,519,800 B2 * 2/2003 Newman et al. ..... 15/230.11
2004/0181893 A1 * 9/2004 Martin et al. ..... 15/230.1

* cited by examiner

*Primary Examiner*—John Kim
*Assistant Examiner*—Shay L. Balsis
(74) *Attorney, Agent, or Firm*—McCormick, Paulding & Huber LLP

(57) ABSTRACT

The present invention provides a roller assembly including a roller support coupled to a handle assembly. The roller support includes a detent releasably engageable with a roller cover. An actuator is coupled to the handle assembly for movement between a neutral position wherein the detent is engaged with the roller cover and a release position wherein the detent is disengaged with the roller cover thereby allowing the roller cover to be removed from the handle assembly. Thus, the present invention provides a quick-release roller assembly for use in applying paint or other material to a surface wherein a roller cover mounted to the roller assembly can be removed without requiring a person to touch the outer surface of the roller cover. Additionally, the present invention provides a roller cover for use with the roller assembly, as well as a pair of bushings for adapting a roller cover for use therewith.

17 Claims, 2 Drawing Sheets

PAINT ROLLER ASSEMBLY

FIELD OF THE INVENTION

The present invention generally relates to a roller assembly for use in applying a coating to a surface, and more particularly, to a paint roller assembly.

BACKGROUND OF THE INVENTION

In general, a roller assembly such as those used to apply paint to a wall, include a roller support attached to a handle. Normally, a roller cover is removably mounted on the roller support for rotation relative to the handle. Typically, the roller cover is disposable and replaceable as desired. As such, the useful life of the roller cover is often quite limited when compared to that of the roller assembly.

Most currently used roller covers are frictionally secured to the roller support. A disadvantage associated with this type of roller assembly, is that, in order to remove the roller cover from the roller support, it is usually necessary to grasp an outer surface of the roller cover and slide it off of the roller support. As the roller cover being removed is normally covered with wet paint or some other type of material, the process of removing the roller cover from the roller assembly can be an undesirable task.

Another disadvantage of the above-described prior art roller assemblies, is that the handle assembly usually includes bushings coupling the roller support to a wire handle. Normally, the bushings are exposed to the paint or other material being applied when the roller assembly is used, allowing the paint to flow between an inner surface of the roller cover and the bushings. Often, the paint between the roller cover and the bushings dries and seals the roller cover to the bushings. Thus, in order to remove the roller cover from the roller assembly it is sometimes necessary to first strike the roller assembly on the edge of a bucket or other structure to break the dried paint away from the bushings, thereby allowing the roller cover to be removed from the roller assembly. Alternatively, it may be necessary to slice, or cut the roller cover along a length thereof, allowing the roller cover to be peeled away from the roller assembly.

Additionally, the paint or other material exposed to the bushings often partially dries or otherwise creates a build-up of material at these couplings and can adversely affect the performance of the roller assembly or the useful life thereof by inhibiting the rotation of the bushings or causing excessive wear to the bushings or roller assembly.

Still another disadvantage associated with many prior art roller assemblies is that often the frictional coupling between an inner diameter of the roller cover and the roller support is not uniform relative to the roller cover. This arrangement can cause gaps between the bushings and the roller cover wherein paint or another work material can flow through these gaps further increasing the possibility of the roller cover becoming sealed to the bushings as described above.

Additionally, the frictional coupling between the roller cover and the roller assembly in many prior art roller assemblies is not sufficient to prevent the roller cover from tracking improperly with respect to the roller support. That is, when using this type of roller assembly, the roller cover often has a tendency to work itself off of the roller support making it necessary to periodically tap an end of the roller cover against something to reposition the roller cover on the roller support. This problem can be exasperated with the presence of paint between the roller cover and the roller support as described above, as the lubriciousness of the paint can further reduce the frictional force between the roller cover and the roller support.

Based on the foregoing, it is the general object of the present invention to provide a roller assembly that improves upon, or overcomes the problems and drawbacks associated with prior art roller assemblies.

SUMMARY OF THE INVENTION

The present invention resides in roller assembly that includes a handle assembly having a roller support rotatably coupled thereto. The roller support includes a detent releasably engageable with a roller cover. An actuator is coupled to the handle assembly for movement between a neutral position wherein the detent is engaged with the roller cover and a release position wherein the detent is disengaged with the roller cover thereby allowing the roller cover to be removed from the handle assembly. Thus, the present invention provides a quick-release roller assembly for use in applying paint or other material to a surface wherein a roller cover mounted to the roller assembly can be removed without requiring a person to touch the outer surface of the roller cover.

In one embodiment of the present invention, the actuator includes a push button wherein the roller cover can be disengaged from the handle assembly by simply holding the handle so that the roller cover is pointed in a downward direction and pressing the push button thereby disengaging the detent from the roller cover and allowing the roller cover to fall from the roller support.

The handle assembly of the present invention includes biasing means for urging the actuator and detent toward the neutral position. The biasing means and detent are arranged so that a roller cover can be quickly mounted on the handle assembly and retained thereon with the detent being engaged with a bushing coupled to the roller cover.

In accordance with the present invention, a roller cover for use with a roller assembly as described above is also provided. The roller cover of the present invention includes a tube having a surfacing material disposed on an outer diameter and a pair of bushings disposed in opposing ends of the tube for rotatably mounting the roller cover on the roller assembly.

Additionally, the present invention provides a pair of bushings for rotatably mounting a roller cover to the above-described roller assembly. The bushings each include outer diameters insertable in opposing ends of a roller cover and each define a bore for receiving the roller support for rotatably coupling the roller cover to the roller assembly. One of the bushings further defines an opening for receiving the detent of the roller support for coupling the roller cover thereto. The bushings can include end caps for facilitating the prevention of axial movement of the roller cover relative to the roller support.

One advantage of the present invention roller assembly is that the biasing means also provides a longitudinal force directed along an axis of the roller support preventing axial movement of the roller cover relative to the roller assembly. This provides increased performance in the roller assembly of the present invention when compared to many prior art devices available.

Another advantage of the present invention is that the roller assembly can include a roller cover having bushings for rotatably coupling the roller cover to the handle assembly wherein the bushings include bearing surfaces that are sealed from the paint or other material being applied with the roller assembly. This provides a more durable and precise roller assembly than many prior art roller assemblies wherein the bushings are exposed to the paint or other material being applied.

DETAILED DESCRIPTION OF THE INVENTION

Figure 1:
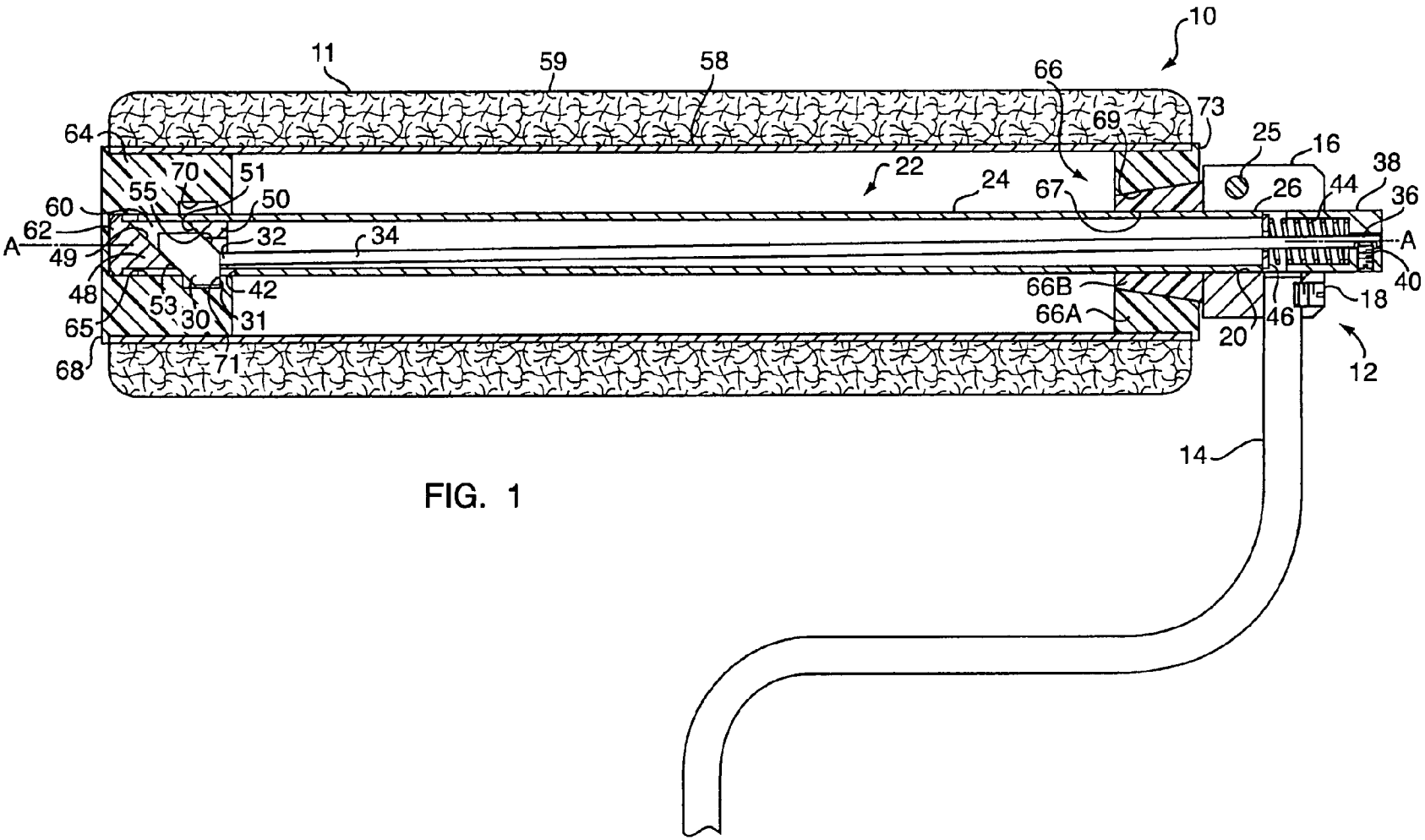
FIG. 1 is a partial, partly in section view of a roller assembly according to the present invention.

As shown in FIG. 1, the present invention is directed to a roller assembly generally designated by the reference number 10 having a roller cover 11 rotatably coupled thereto. The roller assembly 10 includes a handle assembly generally designated by the reference numeral 12. The handle assembly 12 includes a handle 14 having a housing 16 attached to an end thereof. A set screw 18 is used to secure the housing 16 to the handle 14. The present invention is not limited in this regard however, as other types of fasteners, such as adhesives or welds could be utilized to attach the housing 16 to the handle 14. Alternatively, the housing 16 could be manufactured integral to the handle 14. The handle 14 may include an attached handle grip (not shown) for ease in gripping the handle. The housing 16 defines a bore 20 extending through the housing generally transverse to the handle 14.

Figure 4:
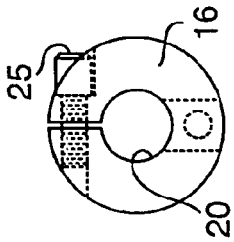
FIG. 4 is an end view of a housing forming part of the roller assembly of FIG. 1.

As shown in FIG. 1, the handle assembly 12 includes a roller support, generally designated by the reference numeral 22 including a hollow tube 24 having an end portion 26 disposed in the bore 20 and attached to the housing 16 via a screw 25. The housing 16 is a split housing as illustrated in more detail in FIG. 4, thus, the screw 25 clamps the housing 16 around the end portion 26, securing the hollow tube 24 to the handle assembly 12. Although the hollow tube 24 is shown clamped to the housing 16, the present invention is not limited in this regard as the hollow tube could be press fit in the bore 20 or fastened to the housing using other means known in the art such as, via an adhesive or welds.

Figure 6:
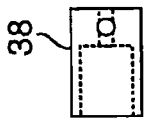
FIG. 6 is a side view of an actuator forming part of the roller assembly of FIG. 1.
Figure 3:
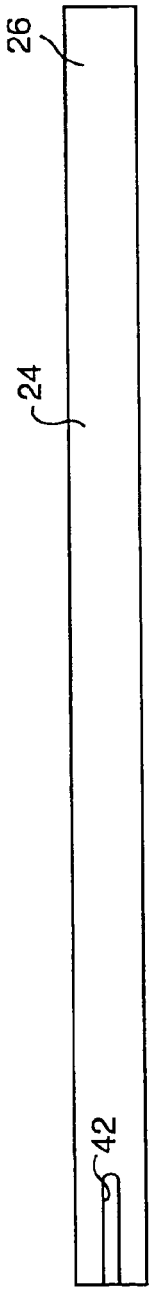
FIG. 3 is a side view of a hollow tube forming part of the roller assembly of FIG. 1.
Figure 5:
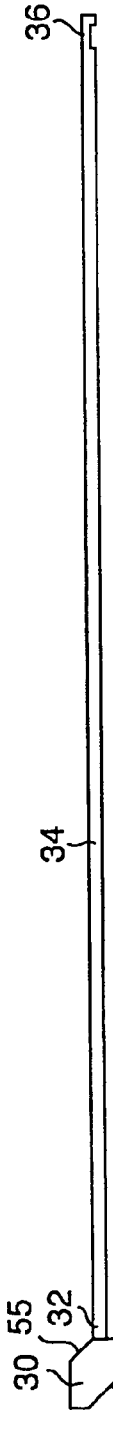
FIG. 5 is a side view of an actuator rod forming part of the roller assembly of FIG. 1.
Figure 9:
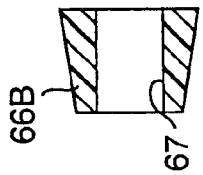
FIG. 9 is a cross-sectional side view of another component of an inner bushing for a roller cover forming part of the roller assembly of FIG. 1.
Figure 8:
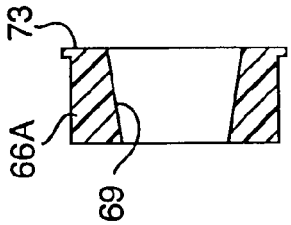
FIG. 8 is a partly in section side view of a portion of an inner bushing for a roller cover forming part of the roller assembly of FIG. 1.

The handle assembly 12 also includes a detent 30 coupled to a first end portion 32 of an actuator rod 34. The actuator rod 34 is partially disposed inside the hollow tube 24 and has a second end portion 36 extending outwardly from the end portion 26 of the hollow tube 24. An actuator 38 is coupled to the second end portion 36 of the actuator rod 34. In the illustrated embodiment, the actuator 38 includes a push button attached to the second end portion 36 of the actuator rod 34 via a set screw 40. The actuator rod 34 and actuator 38 are shown in FIGS. 5 and 6 respectively.

In a neutral position, as depicted in FIG. 1, a portion of the detent 30 extends through an opening 42 defined in the hollow tube 24. A spring 44 is disposed between the actuator 38 and a flat washer 46 positioned adjacent an end of the hollow tube 24. The spring 44 urges the detent 30 against detent guides 48 and 50 positioned interior the hollow tube 24 for maintaining the detent 30 in the neutral position. In the neutral position, as will be discussed further hereinafter, the detent 30 is positioned to engage a roller cover 11 rotatably mounted on the roller support 22.

The detent guides 48 and 50 include angular surfaces 49 and 51 respectively, corresponding to angular surfaces 53 and 55 on the detent 30. In response to a force applied to the actuator 38, the actuator rod 34 moves the detent 30 between the detent guides 48 and 50, such that the detent 30 is progressively moved into a release position wherein the detent no longer extends through the opening 42 in the hollow tube 24, thereby disengaging the detent from the roller cover 11. Thus, in the release position, the roller cover 11 is disengaged from the handle assembly 12.

Figure 2:
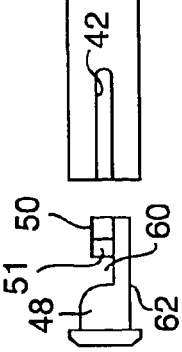
FIG. 2 is a partly in section view of an end plug of the roller assembly of FIG. 1 shown rotated approximately 90°.

As shown in FIGS. 1 and 2, the detent guides 48 and 50 are formed as an angular slot 60 cut in an end plug 62. The detent guide 50 is partially cut-away allowing the detent 30 and the spring 44 to provide a force in the direction of an axis A—A shown on FIG. 1 for eliminating axial movement of the roller cover 11 relative to the handle assembly 12 when the actuator is in the neutral position.

Still referring to FIG. 1, the roller cover 11 includes a roller tube 58 and a surfacing material 59 disposed on the outer surface of the roller tube for carrying paint or other material to be applied to a surface. A pair of bushings, including an outer bushing 64 and an inner bushing 66 comprising an adapter 66A and a conical bushing 66B are disposed and fitted in opposing ends of the roller tube 58. The outer bushing 64 and conical bushing 66B define bores 65 and 67 respectively, sized to provide a bearing surface for rotation of the roller cover 11 about the hollow tube 24 of the roller support 22. Preferably, the inner and outer bushings 64 and 66 are manufactured from a synthetic polymeric material, such as nylon or plastic however, other materials could also be used.

Figure 7:
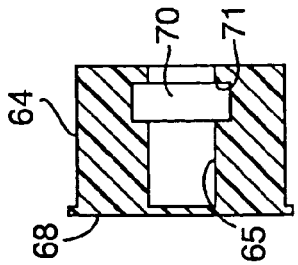
FIG. 7 is a partly in section side view of an outer bushing for a roller cover forming part of the roller assembly of FIG. 1.

As shown in FIG. 7, the outer bushing 64 includes an end cap 68 for preventing paint or other material from contacting the roller support 22. The diameter of the end cap 68 is larger than the diameter of the bushing 64 for engaging the roller tube 58 of the roller cover 11. The bore 65 in the outer bushing 64 further defines a circumferential slot 70 provided to receive the detent 30 for retaining the roller cover 11 on the handle assembly 12. Referring to FIGS. 1, 5 and 7, the detent 30 includes a surface 31 generally perpendicular to the axis A—A that engages a surface 71 of the slot 70 in the outer bushing 64 when the roller cover is mounted on the handle assembly 12 and the detent 30 is in the neutral position. Thus, when the roller cover 11 is retained on the roller support 22 via the bushings 64 and 66, and detent 30, the bushing 64 is urged toward the housing 16 via the spring 44 and the engagement between the surface 31 of the detent 30 and the slot 70 prevents movement of the bushing 64 in the direction of the axis A—A. As the roller tube 58 of the roller cover 11 is engaged in an axial direction with the end cap 68 of the bushing 64, axial movement of the roller cover 11 relative to the roller support 22 is also prevented.

Additionally, in the neutral position, the spring 44 urges the roller cover 11 towards the housing 16 causing the conical bushing 66B to remain adjacent to and in contact with the housing 16 preventing paint or other material from contacting the roller support 22. Thus, the bores 65 and 67 providing bearing surfaces for the rotation of the roller cover 11 about the roller support 22 are sealed from contacting a material such as paint being applied with the roller assembly 10.

The inner bushing 66 includes the adapter 66A having an end cap 73 that defines a conical bore 69 extending therethrough. The conical bore 69 corresponds to an outer surface of the conical bushing 66B. Although, a one piece bushing similar to the outer bushing 64 would suffice for the inner bushing 66 in other embodiments of the present invention, the two piece inner bushing 66 illustrated in FIG. 1 allows the roller cover to be removed from the handle assembly 12 without requiring the actuator 38 to be depressed throughout the time required for the inner bushing 66 to pass over the detent 30. Thus, the "break-away" or "quick-release" bushing 66 including the adapter 66A and the conical bushing 66B allows the roller cover 11 to quickly be removed from the handle assembly 12 after only depressing the actuator 38 for the time required for the slot 70 to pass over an edge of the detent 30. Accordingly, after the roller cover 11 is removed from the handle assembly 12, the conical bushing 66B is retained on the hollow tube 24 via the detent 30. Additionally, if the adapter 66A and the conical bushing 66B do not "break-away" from each other as described above, the detent 30 will catch the conical bushing 66B as the roller cover 11 is removed from the handle assembly 12 and cause the adapter 66A to separate from the conical bushing 66B.

In the neutral position as shown in FIG. 1, the end cap 73 of the adapter 66A is engaged with the roller tube 58 of the roller cover 11 in the direction of the axis A—A further sealing the roller support 22 from contacting paint or other material and preventing axial movement of the roller cover with respect to the roller support.

To mount a roller cover 11 having an outer bushing 64 and an adapter 66A installed in opposing ends thereof on the handle assembly 12 of the FIG. 1 embodiment, only the following steps are required: 1) provide a conical bushing 66B installed on the roller support 22; 2) insert the end of the roller support 22 not attached to the handle 14 in the conical bore 69 of the adapter 66A and slide the roller cover over the roller support inserting the end of the roller support into the bore 65 in the outer bushing 64; and 3) depress the actuator 38 so that the detent 30 is in a release position allowing the outer bushing 64 to pass over the detent. Once the roller cover 11 is completely installed on the roller support 22 and the actuator 38 is released, the detent 30 will engage the outer bushing 64 retaining the roller cover 11 on the handle assembly 12.

The present invention roller assembly 10 includes providing the roller support 22 in various lengths corresponding to the lengths of standard roller covers commonly available. In this respect, the roller support 22 includes the detent 30, actuator rod 34, actuator 38 and the biasing means associated therewith. The roller support 22 can be removed and replaced in the handle assembly 12 via the screw 25 or the entire handle assembly could be provided having roller supports of various lengths. Additionally, the length of the roller support 22 can be adjusted to accommodate variations in the length of the roller cover 11 by loosening the screw 25 and moving the end portion 26 of the hollow tube 24 in or out of the bore 20 accordingly.

The outer and inner bushings 64 and 66 of the present invention can be removed from the roller cover 11 and reused by simply inserting the bushings in the opposing ends of a new roller cover 11. Alternatively, a roller cover 11 can have the bushings 64 and 66 manufactured integral thereto or provided therewith. Further, the bushings 64 and 66 or even 64 and 66A could be made separately available for modifying a standard roller cover to be used with the handle assembly 12 of the present invention.

While materials have not been described for the handle assembly 12 of the present invention, preferably the handle assembly 12 is manufactured of stainless steel or other suitable material such as aluminum or plastic, for providing a high performance and durable roller assembly.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A roller assembly comprising:

a handle assembly including a roller support for mounting a roller cover thereon;

said roller support including a detent releasably engageable with saidroller cover;

an actuator coupled to said detent and movable between a neutral position wherein said detent is engaged with said roller cover and a release position wherein said detent is disengaged with said roller cover thereby allowing said roller cover to be removed from said roller support; and biasing means for normally urging said actuator toward said neutral position.

2. A roller assembly as defined in claim 1 wherein said handle assembly further comprises a handle having said roller support attached thereto.

3. A roller assembly as defined in claim 2 wherein said roller support further comprises a hollow tube defining an opening in a sidewall thereof, said detent being normally biased such that a portion thereof extends through said opening for engaging a roller cover rotatably mounted on said hollow tube.

4. A roller assembly as defined in claim 3 further comprising an actuator rod having one end thereof disposed inside said hollow tube and attached to said detent and having an opposing end portion projecting outwardly from an end of said hollow tube and coupled to said actuator.

5. A roller assembly as defined in claim 4 wherein said biasing means further comprises a spring disposed between said actuator and said end of said hollow tube urging said detent toward said neutral position.

6. A roller assembly as defined in claim 3 further comprising an end plug disposed in an end of said hollow tube wherein said end plug defines at least one detent guide for engaging said detent inside said hollow tube.

7. A roller assembly as defined in claim 1 wherein said detent provides an axial force on a roller cover mounted on said roller support preventing axial movement of said roller cover relative to said roller support.

8. A roller assembly as defined in claim 1 further comprising a roller cover coupled to said roller support for rotation with respect thereto.

9. A roller assembly as defined in claim 8 wherein said roller cover further comprising inner and outer bushings for rotatably coupling said roller cover to said roller support.

10. A roller assembly as defined in claim 9 wherein at least one of said bushings is engageable with said detent for retaining said roller cover on said roller support.

11. A roller assembly as defined in claim 9 wherein at least one of said bushing further comprises at least two separable components.

12. A roller assembly as defined in claim 8 wherein said actuator is operable for disengaging said detent from said roller cover releasing said roller cover from said handle assembly.

13. A roller assembly as defined in claim 1 further comprising a pair of bushings rotatably coupled to said roller support for mounting said roller cover to said roller support.

14. A roller assembly as defined in claim 13 wherein at least one of said bushings defines an opening for engaging said detent.

15. A roller assembly as defined in claim 13 wherein at least one of said bushings includes two separable components.

16. A roller assembly as defined in claim 13 wherein said bushings further comprise end caps engageable with opposing ends of said roller cover.

17. A pair of bushings for rotatably mounting a roller cover to a roller assembly comprising:

a first bushing having an outer diameter insertable in one end of a roller cover for removably coupling said bushing to said roller cover;

a second bushing having an outer diameter insertable in an opposing end of said roller cover for removably coupling said bushing to said roller cover;

said first and second bushings each defining a bore therein for receiving a roller support for rotatably mounting said roller cover on said roller support;

at least one of said first and second bushings further defines a circumferential slot extending outwardly from said bore for receiving a detent coupled to said roller support for securing said roller cover thereto; and wherein at least one of said bushings further comprises at least two separable components, wherein said two components include a conical bushing having a conical outer surface and defining a bore for receiving said roller support, and an adapter defining a conical bore corresponding to said conical outer surface and having an outer diameter insertable in an end of said roller cover, said conical bushing and said adapter cooperate to provide a separable bushing for mounting said roller cover to said roller support.

* * * * *